US009675228B2

(12) United States Patent
Troff et al.

(10) Patent No.: US 9,675,228 B2
(45) Date of Patent: Jun. 13, 2017

(54) FLOOR CLEANING APPARATUS

(71) Applicant: Alfred Kärcher GmbH & Co. KG, Winnenden (DE)

(72) Inventors: Gilles Troff, Stuttgart (DE); Brunhold Roppelt, Rudersberg (DE); Rainer Schaefer, Leutenbach (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 11 days.

(21) Appl. No.: 14/300,739

(22) Filed: Jun. 10, 2014

(65) Prior Publication Data

US 2014/0283327 A1 Sep. 25, 2014

Related U.S. Application Data

(63) Continuation of application No. 13/749,583, filed on Jan. 24, 2013, now Pat. No. 8,776,305, which is a continuation of application No. PCT/EP2011/062572, filed on Jul. 21, 2011.

(30) Foreign Application Priority Data

Jul. 26, 2010 (DE) ..... 10 2010 038 422

(51) Int. Cl.

| | |
|---|---|
| ***A47L 11/29*** | (2006.01) |
| ***A47L 11/28*** | (2006.01) |
| ***A47L 11/30*** | (2006.01) |
| ***A47L 11/40*** | (2006.01) |

(52) U.S. Cl.

CPC ..... *A47L 11/28* (2013.01); *A47L 11/30* (2013.01); *A47L 11/4016* (2013.01); *A47L 11/4025* (2013.01)

(58) Field of Classification Search

CPC ..... A47L 11/28; A47L 11/30; A47L 11/4025; A47L 11/4016

IPC ..... A47L 11/29

See application file for complete search history.

(56) References Cited

U.S. PATENT DOCUMENTS

| | | | |
|---|---|---|---|
| 4,393,538 | A | 7/1983 | Olson |
| 4,667,364 | A | 5/1987 | Meili |
| 4,974,282 | A | 12/1990 | Stoltz et al. |
| 6,061,868 | A | 5/2000 | Moritsch et al. |
| 6,206,980 | B1 | 3/2001 | Robinson |

(Continued)

FOREIGN PATENT DOCUMENTS

| | | |
|---|---|---|
| DE | 816 105 B | 10/1951 |
| DE | 38 16 098 A1 | 11/1989 |

(Continued)

*Primary Examiner* — David Redding

(74) *Attorney, Agent, or Firm* — Womble Carlyle Sandridge & Rice LLP

(57) ABSTRACT

A floor cleaning apparatus is provided, including a dirt collection device for picking up dirty liquid from a floor surface to be cleaned as well as a dirty liquid tank, into which the dirty liquid can be transferred. In order to provide a floor cleaning apparatus of this type, which can be handled in a more user-friendly manner, it is proposed that the floor cleaning apparatus has a tank rinsing mechanism with at least one rinsing line, which includes at least one inlet opening for rinsing liquid, which can be provided for the tank rinsing mechanism, as well as at least one outlet opening for delivering rinsing liquid into an interior of the dirty liquid tank.

25 Claims, 6 Drawing Sheets

(56) References Cited

U.S. PATENT DOCUMENTS

| | | | | |
|---|---|---|---|---|
| 2002/0007529 | A1 | 1/2002 | Legatt et al. | |
| 2002/0083549 | A1* | 7/2002 | Deiterman ..... | A47L 11/30 15/320 |

FOREIGN PATENT DOCUMENTS

| | | | |
|---|---|---|---|
| EP | 0 173 392 | A2 | 3/1986 |
| EP | 0 726 057 | A2 | 8/1996 |
| GB | 2 420 813 | A | 6/2006 |
| RU | 57739 | | 10/2006 |

* cited by examiner 33
30
56
55
52
53
54
54
43
40
41
56
55
55
56
51
12
44
45
28
22
23
29
36
46
47
35
34
57
25
24

FLOOR CLEANING APPARATUS

CROSS-REFERENCE TO RELATED APPLICATIONS

This application is continuation of U.S. patent application Ser. No. 13/749,583, filed on Jan. 24, 2013, which is a continuation of international application number PCT/EP2011/062572, filed on Jul. 21, 2011, which claims priority to German application number DE 10 2010 038 422.4, filed Jul. 26, 2010. The contents of all applications are incorporated by reference herein in their entirety and for all purposes.

FIELD OF THE INVENTION

The present invention relates to a floor cleaning apparatus, comprising a dirt collection device for picking up a dirty liquid from a floor surface to be cleaned as well as a dirty liquid tank, into which dirty liquid is transferable.

BACKGROUND OF THE INVENTION

A floor cleaning apparatus of this type configured, for example, as a scrubbing suction machine, generally comprises, in addition to the aforementioned features, a drivable cleaning tool to detach dirt from the floor surface to be cleaned, for example a brush roller or a disc brush. Moreover, the floor cleaning apparatus typically comprises a reservoir tank for cleaning liquid to be applied to the floor surface, for example water, to which a cleaning chemical can be added to increase the cleaning effect. The mixture of cleaning liquid and detached dirt, the dirty liquid, can be received from the floor surface by means of the dirt collection device and transferred into the dirty liquid tank, for example under the action of a suction unit of the floor cleaning apparatus. Once the work has ended, the dirty liquid can be discharged from the dirty liquid tank by way of an outlet. It may be found, in this case, that dirt remains in the dirty liquid tank.

An object of the present invention is to provide a floor cleaning apparatus of the type mentioned at the outset, which can be handled in a more user-friendly manner.

SUMMARY OF THE INVENTION

In an aspect of the invention, a floor cleaning apparatus comprises a dirt collection device for picking up a dirty liquid from a floor surface to be cleaned as well as a dirty liquid tank, into which dirty liquid is transferable. The floor cleaning apparatus has a tank rinsing mechanism with at least one rinsing line, which comprises at least one inlet opening for rinsing liquid to be supplied to the tank rinsing mechanism, as well as at least one outlet opening for delivering rinsing liquid to an interior of the dirty liquid tank.

BRIEF DESCRIPTION OF THE DRAWING FIGURES

The foregoing summary and the following description may be better understood in conjunction with the drawing figures, of which:

DETAILED DESCRIPTION OF PREFERRED EMBODIMENTS OF THE INVENTION

Figure 1:
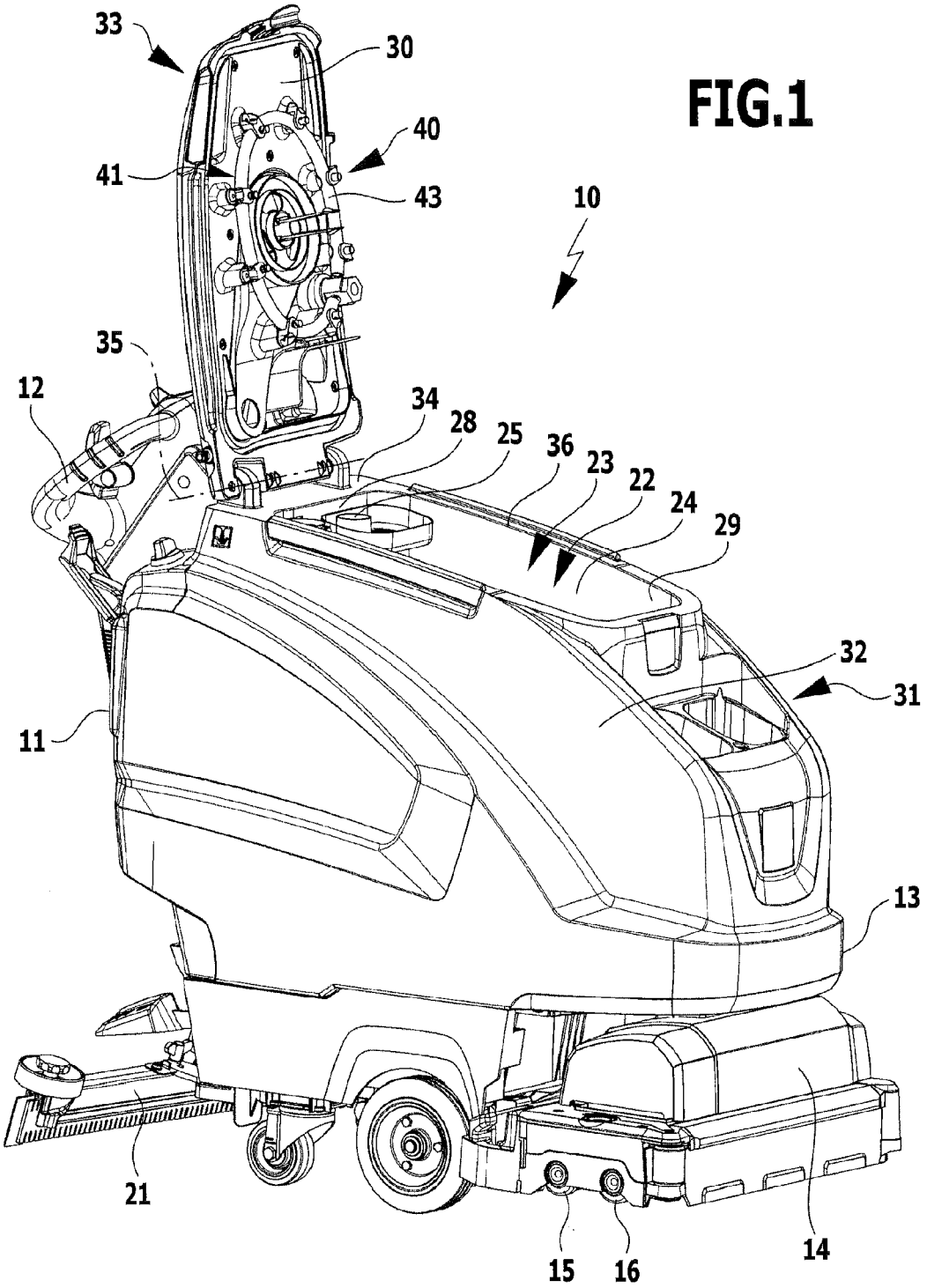
FIG. 1 shows a perspective view of a floor cleaning apparatus according to an embodiment of the invention with an opened lid, which comprises a first variant of a tank rinsing mechanism.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a floor cleaning apparatus that comprises a dirt collection device for picking up a dirty liquid from a floor surface to be cleaned as well as a dirty liquid tank, into which dirty liquid is transferable. The floor cleaning apparatus has a tank rinsing mechanism with at least one rinsing line, which comprises at least one inlet opening for rinsing liquid to be supplied to the tank rinsing mechanism, as well as at least one outlet opening for delivering rinsing liquid to an interior of the dirty liquid tank.

The dirty liquid tank can be cleaned after the work has ended in a user-friendly manner with the aid of the tank rinsing mechanism. For example, a feed hose can be connected to the at least one rinsing line in order to load the tank rinsing mechanism with a rinsing liquid. The rinsing liquid can be delivered through the at least one inlet opening, the at least one rinsing line and the at least one outlet opening into the interior of the dirty liquid tank. After draining off the dirty liquid in the dirty liquid tank, dirt still present can be collected by the rinsing liquid and also discharged by way of the outlet of the dirty liquid tank.

It is favorable if rinsing liquid leaving the at least one outlet opening is directed onto at least one internal wall of the dirty liquid tank. This facilitates the detachment of dirt adhering to the internal wall by means of the rinsing liquid.

Preferably, the at least one outlet opening is arranged on a cover wall of the dirty liquid tank. As a result, the dirty liquid tank can have the rinsing liquid applied from above. This allows the dirty liquid tank to be reliably cleaned.

The at least one rinsing line advantageously has a nozzle comprising the at least one outlet opening. By means of the nozzle arranged on the outlet side on the at least one rinsing line, the rinsing liquid can be distributed in the dirty liquid tank and better cleaning thereof can thereby be achieved. The nozzle may especially be a fan nozzle, the outlet jet of which is directed onto at least one internal wall of the dirty liquid tank, in particular a side wall.

It is advantageous if the at least one rinsing line comprises a plurality of outlet openings, as the rinsing liquid can thus be better distributed in the interior of the dirty liquid tank and better cleaning of the dirty liquid tank can be achieved. The plurality of outlet openings are preferably outlet openings formed on nozzles.

The outlet openings are advantageously arranged on a common rinsing line. This gives the tank rinsing mechanism a structurally simple configuration. Rinsing liquid can leave only one rinsing line through a plurality of outlet openings and enter the interior of the dirty liquid tank.

The arrangement of outlet openings is preferably annular, the rinsing liquid in each case leaving the outlet openings in the radial direction. As a result, effective cleaning of the dirty liquid tank can be achieved. It may be provided that the outlet openings are arranged along the periphery of an internal wall of the dirty liquid tank and that the rinsing liquid in each case leaves the outlet openings radially inwardly. It is also possible for the outlet openings to in each case be arranged at a spacing from the side walls of the dirty liquid tank and for the rinsing liquid to in each case leave the outlet openings radially outwardly. "Annular" in the present case does not necessarily mean "circular ring-shaped", but, in general "along an imaginary, self-enclosed curve", which may also be rectangular, along which the outlet openings are arranged.

The outlet openings may lie in a common plane, which is favorably oriented substantially horizontally during operation of the tank rinsing mechanism. If the outlet openings are formed on fan nozzles, as mentioned above, they can deliver the rinsing liquid, in each case, in the common plane.

It is favorable if the tank rinsing mechanism is fixed to the floor cleaning apparatus. As a result, the tank rinsing mechanism cannot be removed from the floor cleaning apparatus during proper use thereof and become lost.

It may be provided that the at least one outlet opening is formed in an internal wall of the dirty liquid tank, so the rinsing liquid can enter the interior of the dirty liquid tank through the internal wall thereof. One wall of the dirty liquid tank can form the at least one rinsing line as a hollow body, at least in portions, between the internal wall and an external wall.

It is favorable in a different type of embodiment of the floor cleaning apparatus according to an aspect of the invention if formed in one wall of the dirty liquid tank is at least one material recess, through which the at least one rinsing line is guided into the interior of the dirty liquid tank. In this manner, the rinsing liquid can be introduced by a structurally simple tank rinsing mechanism into the interior of the dirty liquid tank. This allows the dirty liquid tank to be cleaned, even in the closed state, and the user to be simultaneously protected from rinsing liquid and dirt. The at least one material recess may, for example, be an aperture of a wall of the dirty liquid tank, through which the at least one rinsing line engages.

It is favorable if the at least one rinsing line has a delivery portion, which is arranged in the interior of the dirty liquid tank and comprises the at least one outlet opening, as well as a feed portion, which has a flow connection to the delivery portion and comprises the at least one inlet opening, and if the at least one inlet opening is arranged outside the dirty liquid tank. Rinsing liquid can thus flow from outside the dirty liquid tank through the feed portion into the interior of the dirty liquid tank and leave from the at least one outlet opening of the delivery portion. The feed portion and the delivery portion can merge into one another, in particular be formed integrally with one another.

The delivery portion is preferably held on a wall of the dirty liquid tank, so that it adopts a defined position relative to the dirty liquid tank. In practice, this leads to better cleaning of the dirty liquid tank.

It is advantageous if the wall is a cover wall of the dirty liquid tank, in particular the cover wall formed or comprised by a movable covering or by a lid of the dirty liquid tank. By holding the delivery portion on the cover wall, for example centrally on the cover wall, the interior of the dirty liquid tank can be loaded with rinsing liquid from above and a better cleaning result can thereby be achieved.

It may be provided that the delivery portion is movably held on the wall, preferably under the action of rinsing liquid leaving the at least one outlet opening in accordance with the recoil principle. The rinsing liquid can be distributed in the interior of the dirty liquid tank owing to the moving delivery portion, and effective cleaning can thus be achieved.

The delivery portion is advantageously movably held on the wall by means of a joint, in order to achieve a defined movement of the delivery portion. The delivery portion is, for example, pivotably mounted on the wall.

In a further, advantageous embodiment of the floor cleaning apparatus, the delivery portion is rotatably mounted on the wall, in particular about a vertical rotational axis. A rotatably mounted delivery portion, for example, comprises the rinsing arm described below, which can be driven to rotate by discharging rinsing liquid.

Advantageously, the delivery portion comprises a self-enclosed delivery line, on which a plurality of outlet openings is arranged. Proceeding from the feed portion, the rinsing liquid can arrive at the outlet openings in two directions. As a result, a pressure loss at the outlet openings due to inner friction of the rinsing liquid flowing through the delivery line can be reduced. Moreover, a plurality of annularly arranged outlet openings can structurally easily be loaded with rinsing liquid if the delivery line is annular.

In addition or alternatively, it may be provided that the delivery portion comprises at least one rinsing arm, which has a flow connection at a first end to the feed portion and has at least one outlet opening at a second end. The delivery portion preferably comprises a plurality of rinsing arms, which can be arranged symmetrically relative to one another. Further outlet openings may be present on the rinsing arm in addition to the at least one outlet opening at the second end of the rinsing arm.

The rinsing arm(s) are favorably rotatably mounted on a wall of the dirty liquid tank, for example about a vertical rotational axis.

The at least one rinsing line preferably runs, at least in portions, in a wall of the dirty liquid tank forming a hollow body. This allows a compact design of the tank rinsing mechanism to be achieved. For example, the aforementioned feed portion runs through a lid of the dirty liquid tank.

The dirty liquid tank preferably comprises a tank opening and a covering, which covering can be transferred from a closure position, in which the tank opening is closed, into an opened position, in which the tank opening is exposed, and vice versa. A user can reach through the tank opening into the interior of the dirty liquid tank, for example to manually clean the dirty liquid tank. Furthermore, the possibility is provided of placing work equipment in the interior before the dirty liquid tank is cleaned by means of the tank rinsing mechanism. The work equipment can thereby be cleaned in the same work operation as the dirty liquid tank, also using the tank rinsing mechanism. The covering is, for example, a lid of the dirty liquid tank, in particular a lid that can be folded up and down.

It is advantageous if the covering comprises the tank rinsing mechanism. This proves to be favorable in practice for a structurally simple integration of the tank rinsing mechanism in an already existing floor cleaning apparatus, which comprises a covering for the dirty liquid tank. By exchanging the existing covering for a covering comprising the tank rinsing mechanism, the advantages of the floor cleaning apparatus according to a preferred embodiment of the invention can be achieved. An exchange of this type is economically feasible.

In order to make it easier for the user to feed rinsing liquid to the at least one rinsing line, it is favorable if at least one inlet opening is arranged on an outer side of the floor cleaning apparatus. The inlet opening may, for example, be arranged laterally on an upper side, in particular on a covering of the dirty liquid tank.

At least one inlet opening is preferably formed by a coupling member of a coupling for liquid lines, which coupling member is arranged on the inlet side on the at least one rinsing line. The at least one rinsing line may, for example, have a coupling member of a hose coupling, for example a standard hose coupling, also known by the designation "quick coupling". This allows the user to connect a feed hose for rinsing liquid to the tank rinsing mechanism.

The rinsing liquid can be fed to the at least one hose line, for example from a water supply network by way of a feed hose.

As an alternative or in addition, it may be provided that the floor cleaning apparatus comprises a rinsing liquid tank and a pump unit connected to the at least one rinsing line, with which pump unit rinsing liquid can be conveyed from the rinsing liquid tank through at least one inlet opening into the at least one rinsing line. This allows rinsing liquid to be fed to the tank rinsing mechanism even when the floor cleaning apparatus is not located close to a water supply network. The rinsing liquid tank may be a tank provided exclusively for storing rinsing liquid. However, it is also possible for the rinsing liquid tank to be the reservoir tank mentioned at the outset for cleaning liquid to be applied to the floor surface.

A liquid delivery line, by means of which the rinsing liquid can be applied to the floor surface to be cleaned, is advantageously connected to an outlet of the pump unit. As a result, the pump unit can be used both for providing rinsing liquid for the tank rinsing mechanism and to apply rinsing liquid to the floor surface.

To achieve a simple construction of the tank rinsing mechanism, it may be provided that the at least one rinsing line is a hose line or is configured at least in portions as a hose line. For example, the aforementioned feed portion and the aforementioned delivery portion comprise hose lines.

FIG. 1 shows a perspective view of a preferred embodiment of a floor cleaning apparatus according to an aspect of the invention, which is configured as a scrubbing suction machine and has overall the reference numeral 10. The scrubbing suction machine 10 is a so-called "walk-behind" machine, which a user can control from the rear side 11 by means of an operating unit 12.

At its front side 13, the scrubbing suction machine 10 has a cleaning tool 14 in the form of a floor cleaning head, which comprises two brush rollers 15 and 16, which can in each case be driven to rotate about a horizontal rotational axis. The cleaning tool 14 can be lowered onto a floor surface to be cleaned, so that the brush rollers 15 and 16 come into contact with the floor surface and dirt can be detached from the floor surface.

Figure 4:
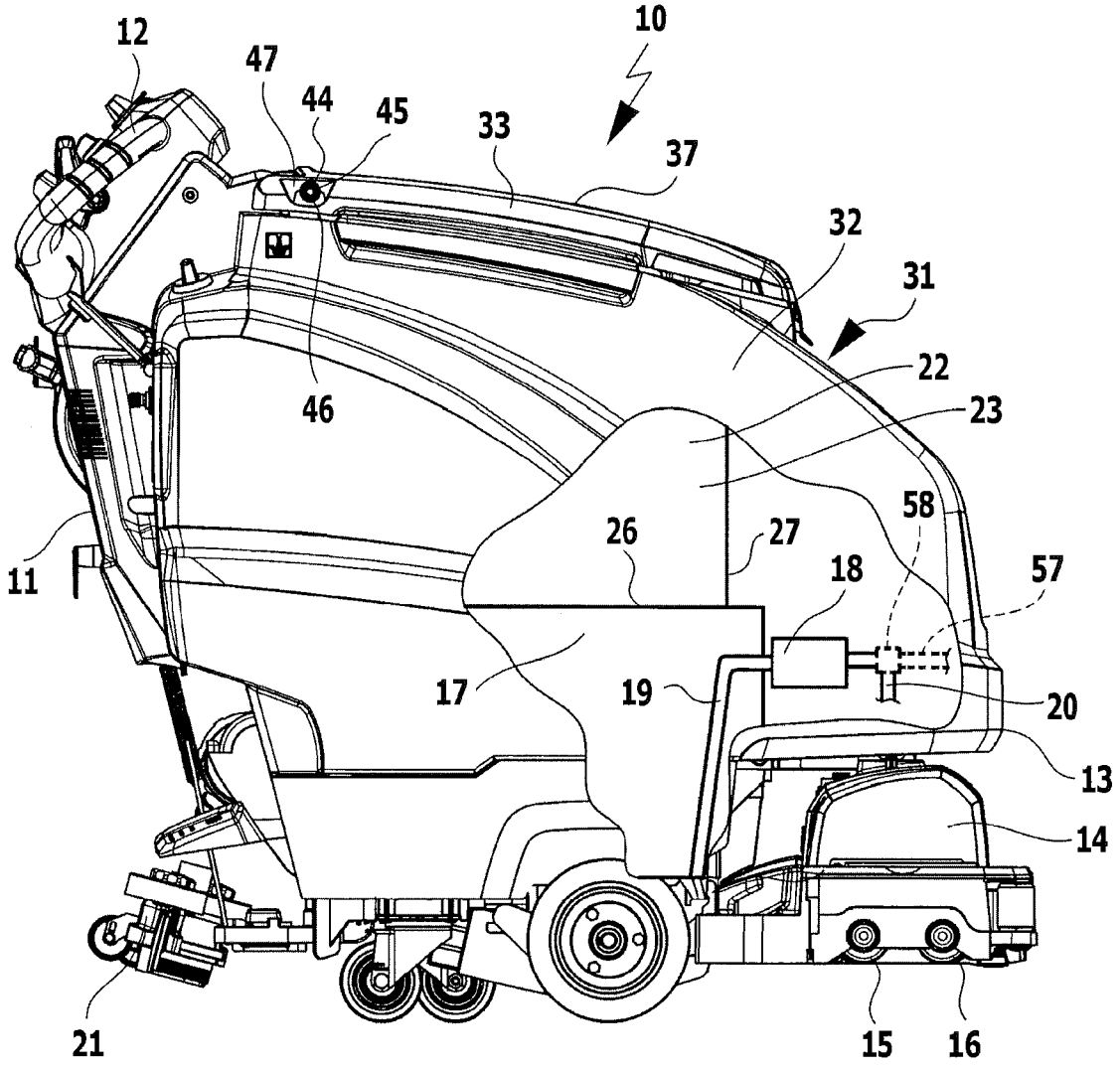
FIG. 4 shows a side view of the floor cleaning apparatus from FIG. 1, partly in section.

To increase the cleaning effect, the scrubbing suction machine 10 comprises a reservoir tank 17 for a cleaning liquid (shown partly schematically in FIG. 4). Water is used as the cleaning liquid, to which a cleaning chemical can be added. On the one hand, it is possible for the cleaning liquid to flow out under the influence of gravity from the reservoir tank 17 onto the floor surface. On the other hand, cleaning liquid can be sucked out of the reservoir tank 17 by means of a pump unit 18, to which a suction line 19 is attached on the inlet side, and fed by way of a liquid delivery line 20 to the cleaning tool 16 for application to the floor surface.

The mixture of dirt and cleaning liquid, called dirty liquid below, can be received by means of a dirt collection device 21, which is arranged on the rear side 11, from the floor surface. For this purpose, the dirt collection device 21 can be subjected to negative pressure in a manner known per se by means of a suction unit of the scrubbing suction machine 10, not shown in the drawing.

The negative pressure loading of the dirt collection device 21 takes place through a dirty liquid tank 22, hereafter tank 23, arranged above the reservoir tank 17. Dirty liquid can be sucked into an interior 24 of the tank 23 through an inlet 25 and deposited in the tank 23. If the dirty liquid is to be drained off from the tank 23, for example after ending the working day or when the tank 23 is completely filled, this may take place by means of an outlet for dirty liquid installed in a base wall 26 of the tank 23, known per se and not shown in the drawing. It frequently occurs here that dirt particles adhere to the walls of the tank 23 and dirt thus undesirably collects in the interior 24.

Figure 2:
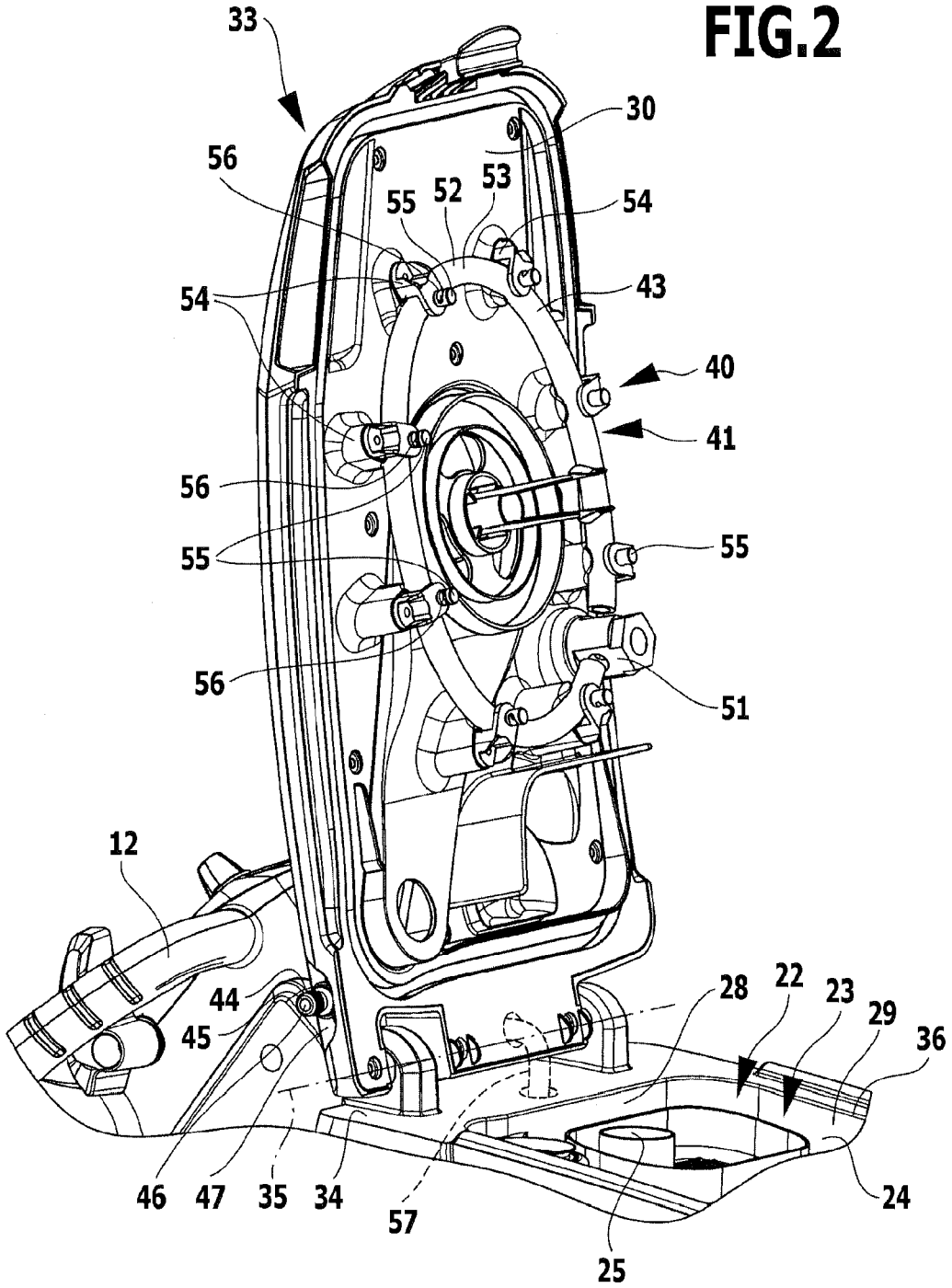
FIG. 2 shows an enlarged partial view of the floor cleaning apparatus from FIG. 1.

As already mentioned, the tank 23 is arranged above the reservoir tank 17. Its interior 24 is limited by the base wall 26, a front wall 27, a rear wall 28, shown to some extent (FIGS. 1 and 2), a left-hand side wall 29, a right-hand side wall, not shown in the drawing, and a cover wall 30. The walls 26 to 29 and the right-hand side wall are formed by a plastics material moulded part, which forms a housing 31 in the form of a hood 32 of the scrubbing suction machine 10.

The cover wall 30 is formed by a lid 33, which is pivotably mounted on the hood 32 about a horizontal pivot axis 35 on an upper side 34 of the scrubbing suction machine 10 close to the operating unit 12. This allows the lid 33 to be transferred from a closure position, in which it covers a tank opening 36 of the tank 23 on the upper side and closes it in a sealing manner (FIG. 4), into an opened position and vice versa. In the opened position (FIGS. 1 and 2) the tank opening 36 is exposed, and a user can reach into the interior 24.

Figure 3:
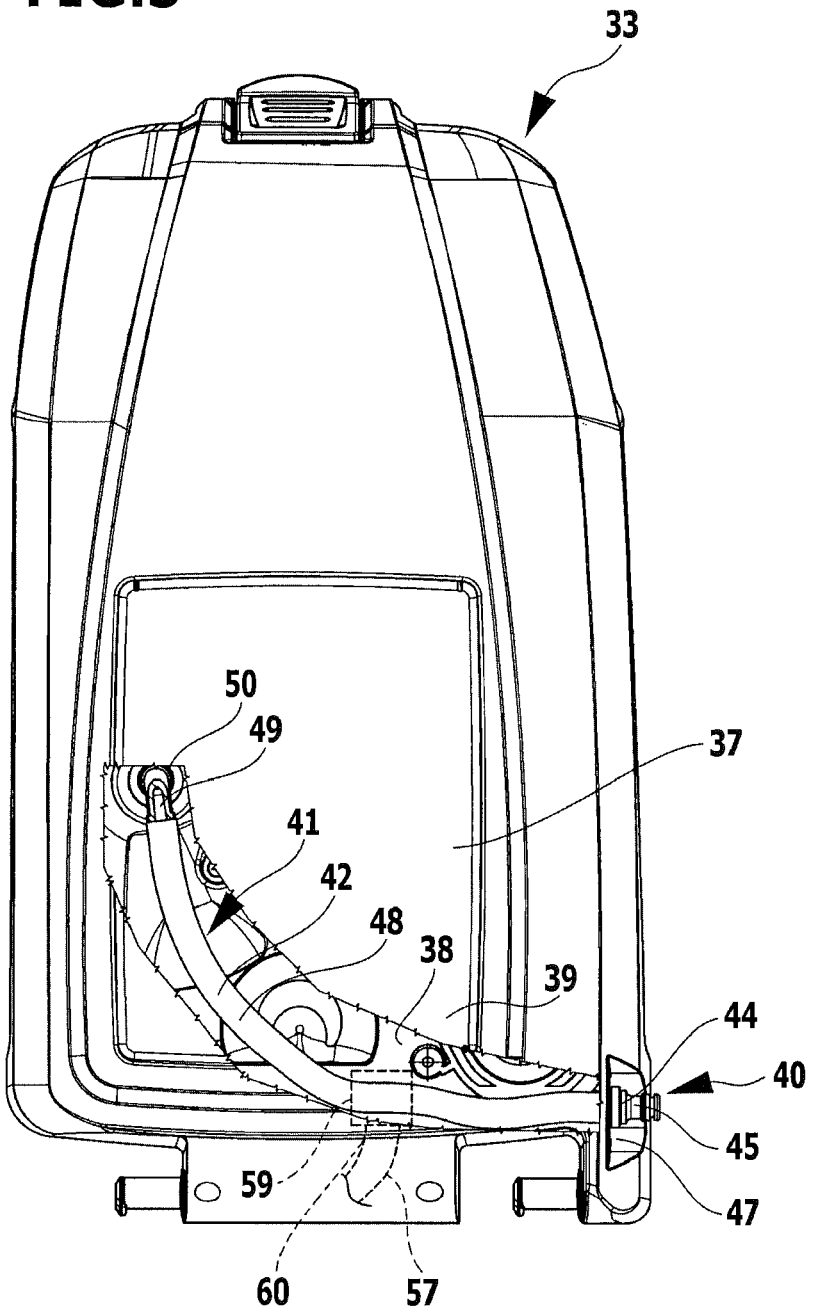
FIG. 3 shows a plan view of the lid of the floor cleaning apparatus from FIG. 1, partly in section.

The lid 30 is double-walled, the cover wall 30 and an outside wall 37 of the lid 33 being arranged at a spacing with respect to one another. An intermediate space 38 is formed in the lid 33 between the cover wall 30 and the outside wall 37 (FIG. 3). The lid 33 thus forms a hollow body 39.

In order to clean the tank 23 of the dirt present in the interior 24, the scrubbing suction machine 10 has an integrated tank rinsing mechanism 40. The tank rinsing mechanism 40 is held completely on the lid 33 and is comprised thereby. The tank rinsing mechanism 40 has a rinsing line 41, which can be loaded with a rinsing liquid, such as, in particular, water, and which is divided into a feed portion 42 substantially arranged in the intermediate space 38 and a delivery portion 43 held on the cover wall 30.

The feed portion 42 comprises at an end side a coupling member 44 in the form of a connection nipple 45 of a standard hose coupling, also known under the name "quick coupling". A coupling member, which corresponds to said connection nipple, of a standard hose coupling can be releasably connected to the connection nipple 45, said coupling member for example being arranged at the end on a feed hose that can be coupled to a water supply network.

The connection nipple 45 forms an inlet opening 46, through which a rinsing liquid, such as, for example, water, can enter the feed portion 42 and is provided for the tank rinsing mechanism 40. The connection nipple 45 is arranged on the outside of the scrubbing suction machine 10, specifically in a recess 47, which is formed on the upper side of the lid 33 and on the right close to the pivot axis 35.

Proceeding from the connection nipple 45, the feed portion 42 passes through a wall of the lid 33 and runs in the intermediate space 38 as a flexible hose line 48. Connected to the end remote from the connection nipple 45 on the hose line 48 is a right-angled connecting piece 49. The connecting piece 49 passes through a material recess 50, which is formed in the cover wall 30 of the lid 33, in the form of an annular aperture (FIG. 3).

A connection element 51 of the delivery portion 43 overlaps the connecting piece 49 and the material recess 50 on the side of the cover wall 30 facing the interior 24. The connection element 51 is connected in a fluid-tight manner to the connecting piece 49. The material recess 50 is also overlapped in fluid-tight manner.

A liquid line 52 of the delivery portion 43, configured in the form of a flexible hose line 53, is connected to the connection element 51 on two mutually opposing sides. In this manner, the connection element 51 and the hose line 53 form a self-enclosed delivery line of the delivery portion 43.

The hose line 53 is arranged centrally on the cover wall 30. It is annular and has an approximately elliptical shape. The hose line 53 is kept in this elliptical shape by means of a plurality of holding members 54, which are formed as clamps on the lower side of the cover wall 30 and in which the hose line 53 is clamped. In total, eight holding members 54 are present, which, in each case, have approximately identical angular spacings from one another in the peripheral direction of the elliptical hose line 53.

Furthermore, the tank rinsing mechanism 40 comprises a plurality of nozzles 55, viz also eight in number, of which each nozzle 55 is held on a holding member 54. The nozzles are fan nozzles, which are arranged at a spacing from the walls of the tank 23 and the outlet openings 56 of which can, in each case, produce a fan-shaped flat jet located in one plane. The nozzles 55 have a flow connection (not shown) to the hose line 53, so they can be loaded with a rinsing liquid by means of the hose line 53. For this reason, the outlet openings 56 of the nozzles 55 are also outlet openings of the delivery portion 43 and therefore of the rinsing line 41.

The tank rinsing mechanism 40 can be used to clean the tank 23 as follows.

The lid 33 is to be transferred into the closure position, so the tank opening 36 is closed. A mechanism providing rinsing liquid can be connected to the connection nipple 45. As mentioned, for example, a feed hose connected to the water supply network can be connected to the connection nipple 45. If the rinsing line 41 is loaded with rinsing liquid, the latter flows through the feed portion 42 into the delivery portion 43.

The rinsing liquid is delivered from the outlet openings 56 of the nozzles 55 into the interior 24, so the walls 26 to 30 and the right-hand side wall of the tank 23 can be cleaned of dirt. It is advantageous here for the rinsing liquid leaving the nozzles 55 to be directed radially outwardly, in each case, toward the walls of the tank 23 in relation to an imaginary centre point of the elliptical hose line 53. This allows the walls of the tank 23 to be cleaned along the entire inner periphery. It is furthermore advantageous for the rinsing liquid to leave the nozzles 55 at the cover wall 30. As a result, the walls of the tank 23 are cleaned from top to bottom of adhering dirt. This allows the tank 23 to be cleaned in a reliable and simultaneously user-friendly manner by the integrated tank rinsing mechanism 40.

Figure 6:
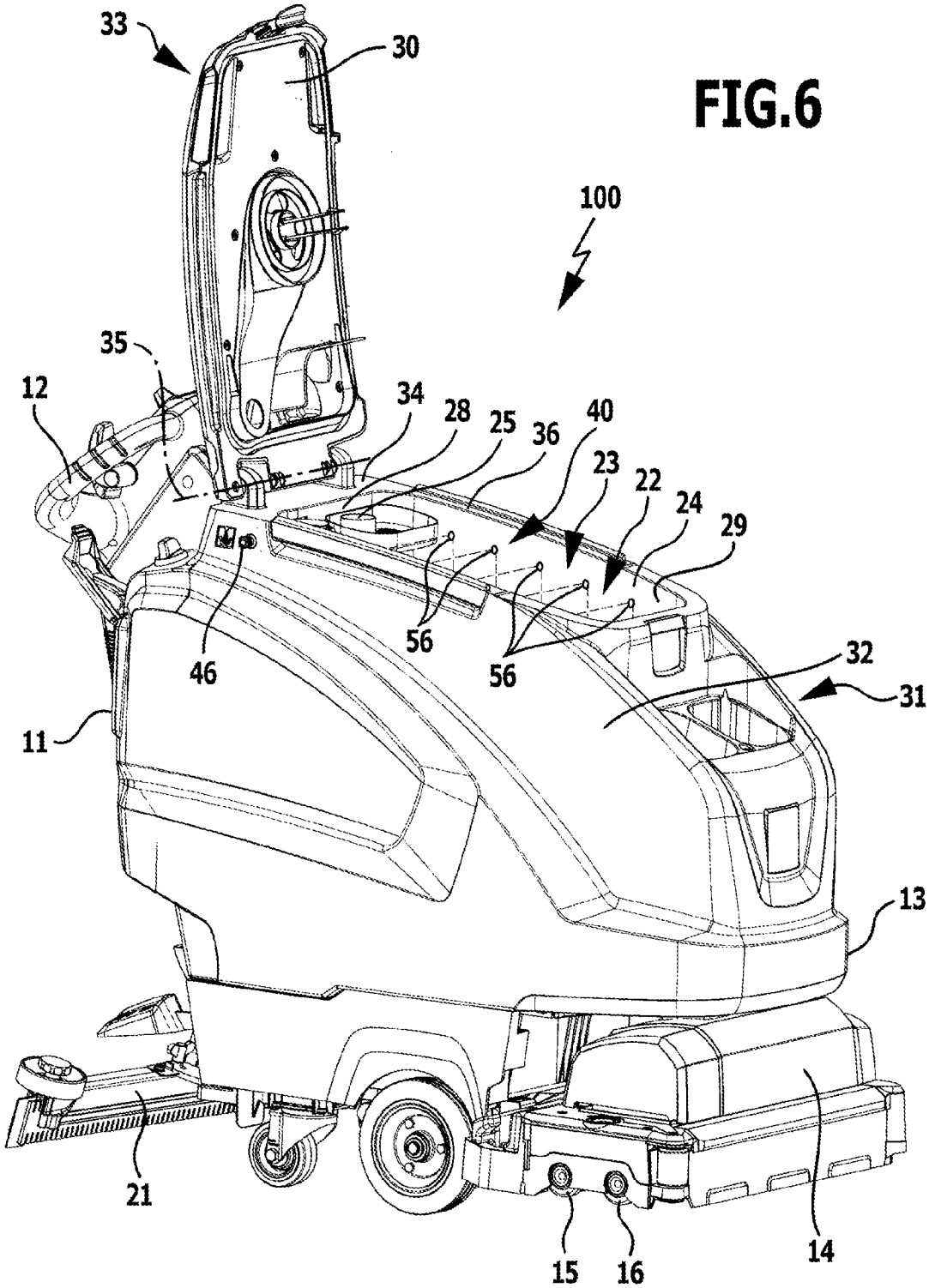
FIG. 6 shows a perspective view of a floor cleaning apparatus according to an embodiment of the invention with an opened lid, which comprises a second variant of a tank rinsing mechanism.

As illustrated in FIG. 6, for example, it may be provided that a floor cleaning apparatus 100 comprises outlet openings 56 arranged along a periphery of an internal wall (i.e., walls 26 to 29) of the dirty liquid tank 23 and that the rinsing liquid in each case leaves the outlet openings 56 radially inwardly.

Because the lid 33 closes the tank opening 33 in a fluid-tight manner, the user is protected against rinsing liquid and dirt. Neither rinsing liquid nor dirt can enter the intermediate space 38 either.

Furthermore, it is possible for a user to place work equipment in the interior 24 before the beginning of the cleaning of the tank 23. This can also be freed of dirt in the course of the cleaning process using the tank rinsing mechanism 40.

Because the lid 33 comprises the tank rinsing mechanism 40 entirely, it is even possible to convert already existing scrubbing suction machines to form a scrubbing suction machine 10 according to an aspect of the invention with low cost outlay by exchanging the lid. In conventional suction machines, the lid without the tank rinsing mechanism merely has to be exchanged for the lid 33 with the tank rinsing mechanism 40, for this purpose.

As already mentioned, the scrubbing suction machine 10 comprises the pump unit 18 for conveying a cleaning liquid in the reservoir tank 17. It may be provided that a feed line 57, indicated by dashed lines in FIG. 4, for the tank rinsing mechanism 40 is connected on the outlet side of the pump unit 18. The feed line 57 may, for example, be connected by means of a valve 58 connected into the liquid delivery line 20 to the pump unit 18.

Thereafter, the feed line 57 can run through the housing 31, leave it on the upper side and enter the intermediate space 38 of the lid 33 through the cover wall 30. This is also indicated by dashed lines in FIG. 2. A valve 59, to which the feed line 57 is also connected, can also be connected into the feed portion 42, in particular its hose line 48 (FIG. 3).

The valves 58 and 59 can be actuated by the user by means of the operating unit 12. Using the pump unit 18, the possibility is provided of using cleaning liquid from the reservoir tank 17 as a rinsing liquid for the tank rinsing mechanism 40. By means of the pump unit 18, this cleaning liquid can be conveyed through the suction line 19 and the feed line 57 into the hose line 48. In this case, the valve 59 forms, in a way, an inlet opening 60 of the rinsing line 41 for rinsing liquid.

Figure 5:
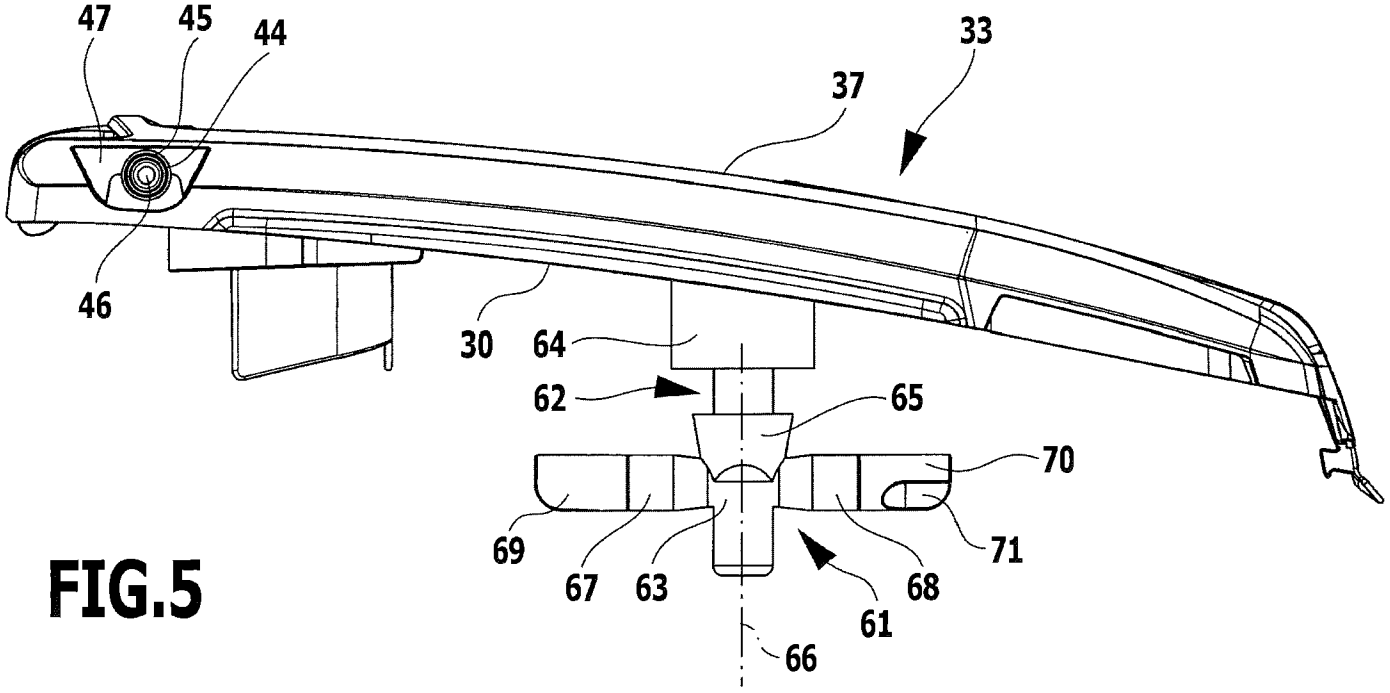
FIG. 5 shows a side view of the lid of the floor cleaning apparatus from FIG. 1, which comprises a second variant of a tank rinsing mechanism.

In a variant of the scrubbing suction machine 10, instead of the tank rinsing mechanism 40, another type of tank rinsing mechanism 61 is used with a rinsing line 62, which is divided into the feed portion 42 and a delivery portion 63, which differs from the delivery portion 43. FIG. 5 shows a side view of the lid 33 with the tank rinsing mechanism 61 surrounded by it.

Instead of the connection element 51, a connection element 64 is used in the delivery portion 63, said connection element 64 also being held at the lower side on the cover wall 30 and engaging (not shown) in a sealing manner over the connecting piece 49 and the material recess 50. A rotor 65 of the delivery portion 53 is rotatably mounted about a vertical axis 66 on the connection element 64. The rotor 65 is received centrally on the cover wall 30. It comprises two rinsing arms 67 and 68, which are mutually diametrically opposing with respect to the axis 66. Nozzles 69 and 70, which, as in the case of the nozzles 55, are fan nozzles, are arranged on the free ends of the rinsing arms 67 and 68. Each of the nozzles 69 and 70 has an outlet opening for rinsing liquid, of which only one outlet opening 71 of the nozzle 70 can be seen in the drawing.

If a rinsing liquid is fed to the tank rinsing mechanism 61 through the inlet opening 46, it flows through the feed portion 42 into the delivery portion 63, from which it can leave through the nozzles 69 and 70 and enter the interior 24. The flat jets leaving the nozzles 69 and 70 are oriented approximately horizontally, so the rotor 65 is made to rotate under the action of the discharging rinsing liquid. In addition, the walls of the tank 23 have the rinsing liquid applied. This also allows effective cleaning of the tank 23 of dirt.

The tank rinsing mechanism 61 can also be connected by means of the feed line 57 to the pump unit 18.

The invention claimed is:

1. A floor cleaning apparatus, comprising a dirt collection device for picking up a dirty liquid from a floor surface to be cleaned as well as a dirty liquid tank, into which the dirty liquid is transferable, wherein the floor cleaning apparatus has a tank rinsing mechanism with at least one rinsing line, which comprises at least one inlet opening for rinsing liquid to be supplied to the tank rinsing mechanism, and a plurality of outlet openings for delivering rinsing liquid to an interior of the dirty liquid tank, wherein rinsing liquid leaving the plurality of outlet openings is directed onto at least one internal side wall of the dirty liquid tank, wherein the arrangement of outlet openings is annular, and wherein the outlet openings in each case are arranged in a spacing from internal side walls of the dirty liquid tank, the rinsing liquid in each case leaving the outlet openings radially outwardly, with respect to the annular arrangement, and towards the at least one internal side wall.

2. The floor cleaning apparatus according to claim 1, wherein the plurality of outlet openings is arranged on a cover wall of the dirty liquid tank.

3. The floor cleaning apparatus according to claim 1, wherein the at least one rinsing line has nozzles, each comprising an outlet opening.

4. The floor cleaning apparatus according to claim 3, wherein the nozzles are fan nozzles.

5. The floor cleaning apparatus according to claim 1, wherein the outlet openings are arranged on a common rinsing line.

6. The floor cleaning apparatus according to claim 1, wherein the tank rinsing mechanism is fixed to the floor cleaning apparatus.

7. The floor cleaning apparatus according to claim 1, wherein there is formed in a wall of the dirty liquid tank at least one material recess, through which the at least one rinsing line is guided into the interior of the dirty liquid tank.

8. The floor cleaning apparatus according to claim 1, wherein the at least one rinsing line has a delivery portion, which is arranged in the interior of the dirty liquid tank and comprises the plurality of outlet openings, as well as a feed portion, which has a flow connection to the delivery portion and which comprises the at least one inlet opening, and wherein the at least one inlet opening is arranged outside the dirty liquid tank.

9. The floor cleaning apparatus according to claim 8, wherein the delivery portion is held on a wall of the dirty liquid tank.

10. The floor cleaning apparatus according to claim 9, wherein the wall is a cover wall of the dirty liquid tank.

11. The floor cleaning apparatus according to claim 9, wherein the delivery portion is held on the wall so as to be movable.

12. The floor cleaning apparatus according to claim 11, wherein the delivery portion is mounted on the wall so as to be rotatable.

13. The floor cleaning apparatus according to claim 8, wherein the delivery portion comprises a self-enclosed delivery line, on which the plurality of outlet openings is arranged.

14. The floor cleaning apparatus according to claim 8, wherein the delivery portion comprises at least one rinsing arm, which has a flow connection at a first end to the feed portion and has at least one outlet opening at a second end.

15. The floor cleaning apparatus according to claim 1, wherein the at least one rinsing line runs, at least in portions, in a wall of the dirty liquid tank forming a hollow body.

16. The floor cleaning apparatus according to claim 1, wherein the dirty liquid tank comprises a tank opening and a covering, which covering is transferable from a closure position, in which the tank opening is closed, into an opened position, in which the tank opening is exposed, and vice versa.

17. The floor cleaning apparatus according to claim 16, wherein the covering comprises the tank rinsing mechanism.

18. The floor cleaning apparatus according to claim 16, wherein the covering is a lid of the dirty liquid tank that is adapted to be folded up and down.

19. The floor cleaning apparatus according to claim 1, wherein at least one inlet opening is arranged on an outer side of the floor cleaning apparatus.

20. The floor cleaning apparatus according to claim 1, wherein the at least one internal wall is a side wall of the dirty liquid tank.

21. The floor cleaning apparatus according to claim 20, wherein the tank rinsing mechanism is adapted to clean side walls of the dirty liquid tank along an entire inner periphery of the dirty liquid tank.

22. The floor cleaning apparatus according to claim 1, wherein at least one inlet opening is formed by a coupling member, which is arranged on the inlet side on the at least one rinsing line, of a coupling for liquid lines.

23. The floor cleaning apparatus according to claim 1, wherein the floor cleaning apparatus comprises a rinsing liquid tank as well as a pump unit, which is connected to the at least one rinsing line and with which rinsing liquid is conveyable out of the rinsing liquid tank through at least one inlet opening into the at least one rinsing line.

24. The floor cleaning apparatus according to claim 23, wherein the floor cleaning apparatus comprises a liquid delivery line connected to an outlet of the pump unit, by way of which rinsing liquid can be applied to the floor surface to be cleaned.

25. A floor cleaning apparatus, comprising a dirt collection device for picking up a dirty liquid from a floor surface to be cleaned as well as a dirty liquid tank, into which the dirty liquid is transferable, wherein the floor cleaning apparatus has a tank rinsing mechanism with at least one rinsing line, which comprises at least one inlet opening for rinsing liquid to be supplied to the tank rinsing mechanism, and a plurality of outlet openings for delivering rinsing liquid to an interior of the dirty liquid tank, wherein rinsing liquid leaving the plurality of outlet openings is directed onto at least one internal side wall of the dirty liquid tank, wherein the arrangement of outlet openings is annular, and wherein the plurality of outlet openings is arranged along a periphery of the internal wall, the rinsing liquid in each case leaving the plurality of outlet openings radially inwardly, with respect to the periphery of the internal side wall, and towards the at least one internal side wall.

* * * * *